US007698981B2

(12) United States Patent
Goldman et al.

(10) Patent No.: US 7,698,981 B2
(45) Date of Patent: Apr. 20, 2010

(54) FORCED PREMATURE DETONATION OF IMPROVISED EXPLOSIVE DEVICES VIA NOISE PRINT SIMULATION

(75) Inventors: Stuart Owen Goldman, Scottsdale, AZ (US); Richard E Krock, Naperville, IL (US); Karl F Rauscher, Emmaus, PA (US); James Philip Runyon, Wheaton, IL (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 228 days.

(21) Appl. No.: 11/317,481

(22) Filed: Dec. 22, 2005

(65) Prior Publication Data

US 2008/0134868 A1 Jun. 12, 2008

(51) Int. Cl.
*F41F 5/00* (2006.01)

(52) U.S. Cl. ..... 89/1.13; 102/402

(58) Field of Classification Search ..... 89/1.13; 102/402

See application file for complete search history.

(56) References Cited

U.S. PATENT DOCUMENTS 6,561,072 B1 * 5/2003 Laine et al. ..... 89/1.13

FOREIGN PATENT DOCUMENTS

GB 2345471 A * 7/2000

* cited by examiner

*Primary Examiner*—J. Woodrow Eldred
*Assistant Examiner*—Gabriel J Klein
(74) *Attorney, Agent, or Firm*—Carmen Patti Law Group, LLC

(57) ABSTRACT

An Improvised Explosive Device (IED) defense system is described that forces premature detonation of IEDs by radiated sound energy signals. Embodiments of the invention provide for radiating sound energy signals from a stationary or mobile platform to a stationary or mobile area defining an "IED detonation zone." IEDs within the IED detonation zone that are triggered by sound energy sources will receive the radiated sound energy signals, thereby forcing premature detonation of IEDs in the detonation zone.

5 Claims, 3 Drawing Sheets

FORCED PREMATURE DETONATION OF IMPROVISED EXPLOSIVE DEVICES VIA NOISE PRINT SIMULATION

CROSS-REFERENCE TO RELATED APPLICATIONS

This application is related to U.S. patent application Ser. No. 11/317,484, titled "Forced Premature Detonation of Improvised Explosive Devices via Radiated Electromagnetic Energy," Ser. No. 11/317,485, titled "Forced Premature Detonation of Improvised Explosive Devices via Heavy Vibration," Ser. No. 11/317,492, titled "Forced Premature Detonation of Improvised Explosive Devices via Laser Energy" and Ser. No. 11/317,605, titled "Forced Premature Detonation of Improvised Explosive Devices via Chemical Substances," each filed concurrently with the present application and assigned to the assignee of the present invention.

FIELD OF THE INVENTION

This invention relates generally to counter-terrorism methods and devices and, more particularly, to methods and devices for triggering premature detonation of Improvised Explosive Devices (IEDs) utilizing sound energy.

BACKGROUND OF THE INVENTION

An Improvised Explosive Device (IED) is an explosive device that is cobbled together (or "improvised") for example, from commercial or military explosives, homemade explosives, military ordnance and/or ordnance components, typically by terrorists, guerrillas or commando forces for use in unconventional warfare. IEDs may be implemented for the purpose of causing death or injury to civilian or military personnel, to destroy or incapacitate structural targets or simply to harass or distract an opponent. IEDs may comprise conventional high-explosive charges alone or in combination with toxic chemicals, biological agents or nuclear material. IEDs may be physically placed at or near a pre-determined target or carried by person or vehicle toward a predetermined target or target of opportunity.

As will be appreciated, the design of construction of an IED and the manner and tactics for which a terrorist may employ an IED may vary depending on the available materials and sophistication of the designer. As such, a variety of different triggering mechanisms could be used to trigger detonation of IEDs. It is contemplated that certain IEDs, either by design or by nature of the triggering mechanism, may detonate responsive to exposure to radiated sound energy of a certain type or characteristic. For example and without limitation, high-intensity sounds or "noise prints" having a characteristic sound pattern could be used to trigger detonation of IEDs. It is a concern that these tactics can be used to trigger bombings against civilian and military targets throughout the world. Accordingly, there is a need for precautionary measures to respond to this threat.

SUMMARY OF THE INVENTION

The present invention provides systems and methods for guarding against sound-energy-triggered IEDs by forcing premature detonation of the IED at a safe distance from a prospective target, thereby reducing the effectiveness of the IED. Embodiments of the invention provide for radiating sound waves (e.g., high-intensity sound waves or noise prints) from a stationary or mobile platform (hereinafter "Sound-Energy Platform (SEP)) to a stationary or mobile area defining an "IED detonation zone." IEDs within the IED detonation zone that are triggered by sound energy sources will receive the radiated sound waves, thereby forcing premature detonation of IEDs in the detonation zone.

BRIEF DESCRIPTION OF THE DRAWINGS

The foregoing and other advantages of the invention will become apparent upon reading the following detailed description and upon reference to the drawings in which.

DESCRIPTION OF THE PREFERRED EMBODIMENT(S)

Figure 1:
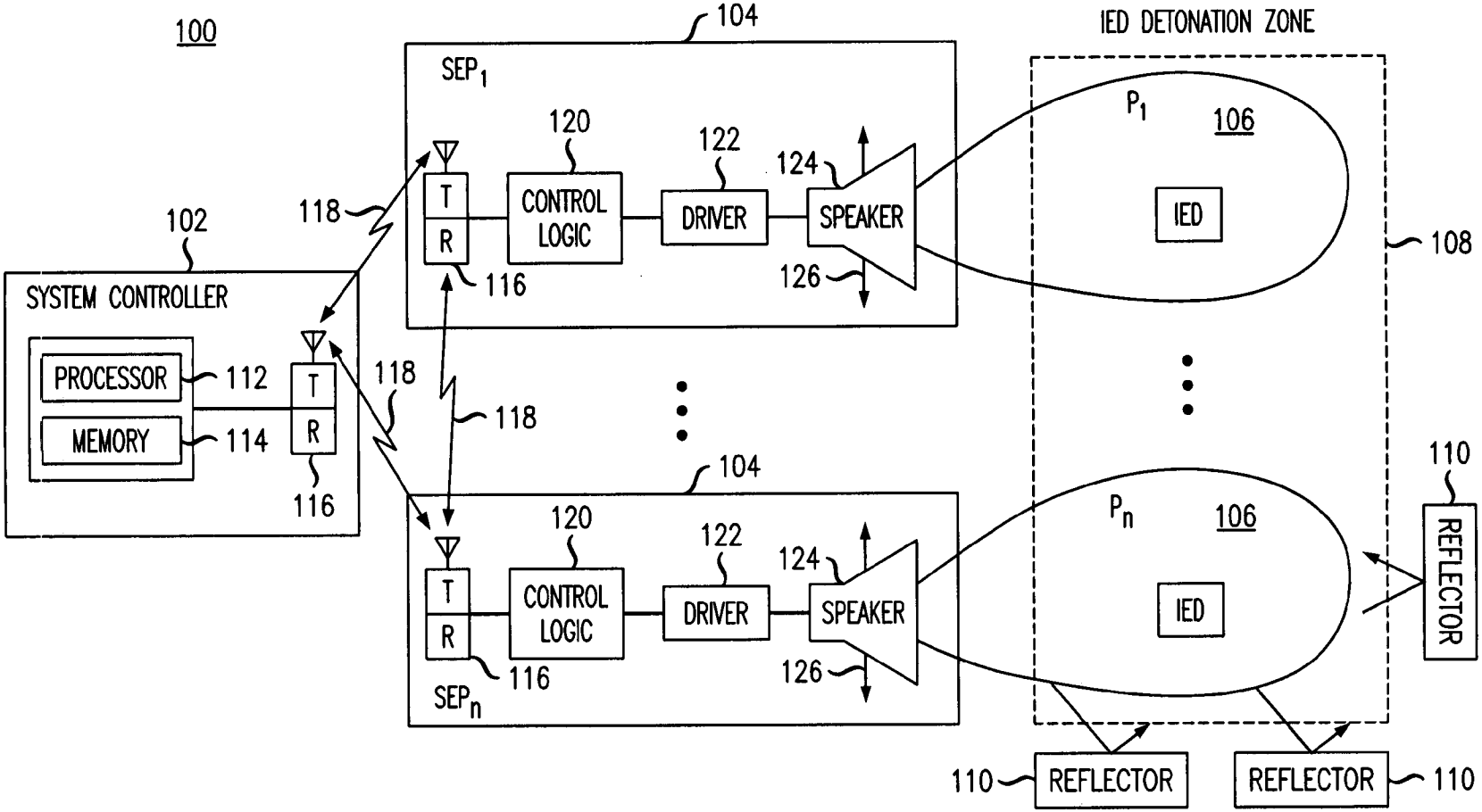
FIG. 1 is a block diagram of an IED defense system including one or more Sound-Energy Platforms (SEPs) according to embodiments of the invention.

FIG. 1 shows by way of example and not limitation, an IED defense system 100 for guarding against sound-energy-triggered IEDs. A system controller 102 controls and coordinates operation of one or more Sound-Energy Platforms 104 ($SEP_1 \ldots SEP_n$). The SEPs 104 operate responsive to activation by the system controller to radiate sound waves defining respective sound wave patterns 106 ($P_1 \ldots P_n$) within an IED detonation zone 108. In one embodiment, the patterns 106 operate individually or collectively to create sound energy coverage at multiple angles, sweeping horizontal and vertical paths so as to cause detonation of IEDs triggered by sound energy sources within the IED detonation zone. Optionally, reflectors 110 may be employed to receive and reflect the sound wave patterns and thereby enhance sound energy coverage within the IED detonation zone.

The system controller 102 includes a processor 112 and memory 114 for controlling the operation of SEPs within the IED defense system 100. In one embodiment, the processor executes software routines for managing operation of the various SEPs, including, for example and not limitation, activating and de-activating the SEPs and controlling intensity and/or direction of the sound wave patterns 106. The memory stores software routines for controlling the SEPs and information relating to the identity, characteristics and location of the various SEPs in the IED defense system. Alternatively or additionally, the system controller may 102 operate responsive to manual input from a human operator (not shown). As will be appreciated, the system controller 102 is a functional element that may reside in a single device or may be distributed among multiple devices and multiple locations. For example and without limitation, the system controller functionality may reside in a centralized platform; or controller functionality may reside in individual SEPs to allow for independent operation of the SEPs.

As shown, the system controller includes a transceiver 116 for communicating with the SEPs 104 via wireless resources 118. The SEPs 104 similarly include transceivers 116 for communicating with the system controller, or with each other, via wireless resources 118. As will be appreciated, the wireless transceivers may be eliminated, for example, in embodiments where controller functionality resides within the SEP. The wireless resources 118, where applicable, may comprise narrowband frequency modulated channels, wideband modulated signals, broadband modulated signals, time division modulated slots, carrier frequencies, frequency pairs or generally any medium for communicating information to or from the SEPs. The wireless resources may implement air interface technologies including but not limited to, CDMA, TDMA, GSM, UMTS or IEEE 802.11.

The SEPs 104 execute control logic 120 responsive to instructions from the system controller 102 (or where applicable, from its own resident controller) to activate respective drivers 122 for driving respective sound energy transmitters (i.e., speakers) 124. Responsive to the control logic and drivers, the electromagnetic energy transmitters radiate sound waves defining respective sound wave patterns 106 ($P_1 \ldots P_n$) within the IED detonation zone 108. As will be appreciated, the nature and type of the transmitters may be selected to produce one or more characteristic type(s) of sound energy and yielding corresponding sound wave pattern(s) that are believed to trigger detonation of IEDs. In one embodiment, the radiated sound energy comprises high intensity or high volume sound patterns. In another embodiment, the sound energy produces a characteristic pattern ("noise pattern") simulating a prospective target. For example and without limitation, the SEPs may be implemented to produce the sound of a siren or the rumble of a heavy truck.

Generally, it is contemplated that virtually any type of sound energy may be employed and at varying intensity, frequencies or the like to produce a desired characteristic sound wave pattern. Further, the physical location and/or direction of the transmitters may be varied to produce sound wave patterns at multiple angles and directions or to sweep different paths, individually or collectively. Optionally, the speakers 124 may mechanically pivot (pivoting motion denoted by arrows 126) to effect different pointing angles and hence, different sound wave patterns 106. Further, one or more reflectors 110 may be deployed to receive and reflect the sound wave patterns and hence, yield sound wave patterns at still further angles and directions so as to achieve even greater coverage within the IED detonation zone.

As will be described in greater detail in relation to FIG. 2 and FIG. 3, the SEPs and/or reflectors may be deployed on mobile or stationary platforms, or some combination thereof, to effect a mobile or stationary IED detonation zone 108. In either case, the IED detonation zone is advantageously positioned a safe distance from civilian or military personnel or structural targets, such that detonation of IEDs in the zone will not cause significant damage to persons or property. Detonation of IEDs within the zone is referred to as a forced premature detonation since it is instigated by the IED defense system 100 and will occur before intended by the person or agency deploying the IED.

Figure 2:
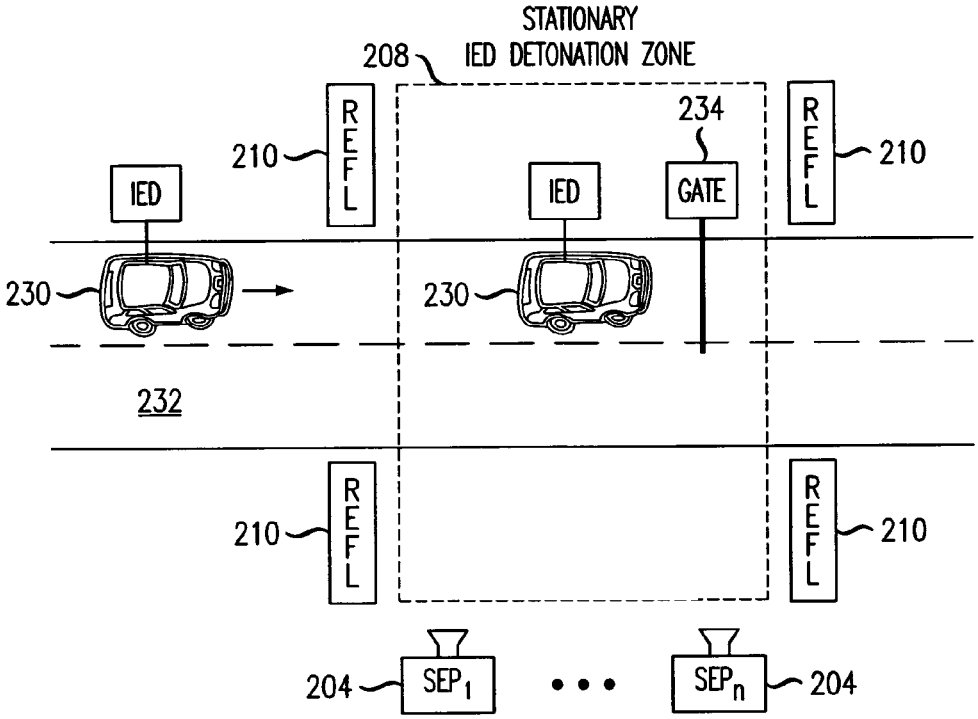
FIG. 2 illustrates a manner of deploying SEPs and reflectors about a stationary target area defining a stationary IED detonation zone.

FIG. 2 illustrates a manner of deploying SEPs and reflectors about a stationary target area defining a stationary IED detonation zone. For convenience, similar reference numerals will be used to describe like elements in FIG. 1 and FIG. 2, albeit with "200" series reference numerals in FIG. 2 rather than "100" series. For example, the IED detonation zone, referred to by reference numeral 108 in FIG. 1 will be referred to by reference numeral 208 in FIG. 2.

In the embodiment of FIG. 2, a stationary IED detonation zone 208 is defined by deploying one or more SEPs 204 and reflectors 210 at predetermined fixed positions about a designated geographic area in which premature detonation of IEDs is desired. The designated geographic area may comprise, for example, a remote checkpoint or staging area situated a safe distance (e.g., 500 ft.) from persons or structures that may be targeted by IEDs. When activated, the SEPs 204 and reflectors 210 produce sound waves sweeping various angles and directions within the IED detonation zone, substantially as described in relation to FIG. 1, so as to force premature detonation of IEDs within or entering the zone 108. The SEPs may be activated responsive to a system controller (not shown in FIG. 2) or a human operator.

As shown, vehicle 230 is traveling on a transportation path 232 (e.g., a roadway) toward a prospective target or target area. Vehicle 230 is carrying an IED that may be triggered to detonate by sound energy. As the vehicle proceeds along path 232, it encounters and enters the stationary IED detonation zone 208. It is noted, although vehicle 230 is depicted as a terrestrial vehicle navigating a terrestrial path in FIG. 2, IEDs might also be carried by aircraft or sea craft navigating an airway or seaway, respectively. Further, human operators may carry IEDs into the IED detonation zone. The IED detonation zone 208 may be arranged and constructed to accommodate any of these scenarios.

Generally, when a person or vehicle first approaches the IED detonation zone, it is not known to be carrying an IED and even if an IED is detected, the type of triggering device may not be known. Accordingly, any unidentified person or vehicle entering the IED detonation zone will at least initially be perceived as a threat. Consequently, in one embodiment, the person or vehicle is stopped upon entering the IED detonation zone. Optionally, a gate 234 is utilized to facilitate stopping the person or vehicle. While the person or vehicle is stopped, or generally at any time while the person or vehicle is within the detonation zone 208, the SEPs 204 may be activated to generate sound energy (e.g., high intensity sound waves or characteristic noise prints) sweeping various angles about the person or vehicle. In such manner, any IEDs carried by the person or vehicle that are triggered by sound energy are prematurely detonated within the zone 208. An alternative implementation is that the zone is sufficiently wide that the person or vehicle does not need to be impeded by a gate, but will be in the zone for sufficiently long enough time as to allow the sound energy to cause premature detonation of the IED.

Figure 3:
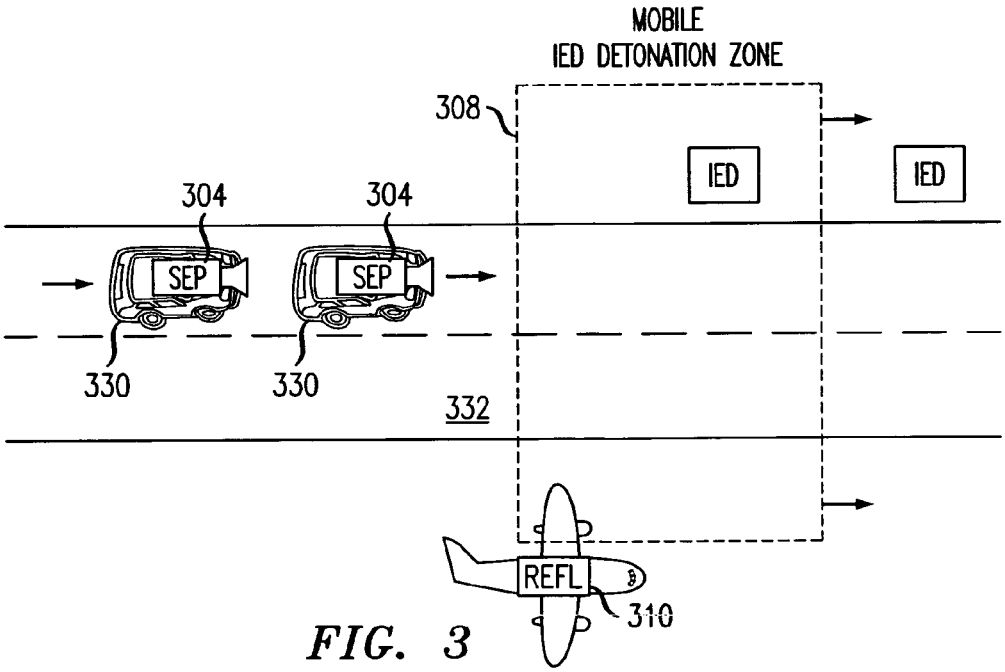
FIG. 3 illustrates a manner of deploying SEPs and reflectors about a mobile target area defining a mobile IED detonation zone.

FIG. 3 illustrates a manner of deploying SEPs and reflectors about a mobile target area defining a mobile IED detonation zone. For convenience, similar reference numerals will be used to describe like elements in FIG. 1 and FIG. 3, albeit with "300" series reference numerals in FIG. 3. For example, the IED detonation zone, referred to by reference numeral 108 in FIG. 1 will be referred to by reference numeral 308 in FIG. 3.

In the embodiment of FIG. 3, one or more SEPs 304 are deployed on vehicles 330 traversing a transportation path (e.g., roadway) 332. In one implementation, the vehicles 330 comprise drone vehicles traveling in advance of a convoy of troops. At various points along the transportation path 332, the vehicles 330 may encounter IEDs that are possibly triggered by sound energy. The SEPs 304, when activated, produce a mobile IED detonation zone 308 that advances along the transportation path 332 along with the mobile platform. The SEPs may be activated responsive to a system controller (not shown in FIG. 3) or a human operator. The IED detonation zone 308 comprises sound energy (e.g., high intensity sound waves or characteristic noise prints) sweeping various angles and directions, substantially as described in relation to FIG. 1. As such, any IEDs on the transportation path that are encountered by the advancing IED detonation zone 308 are likely to become prematurely detonated if they are triggered by sound energy. Advantageously, as shown, the IED detonation zone 308 is wide enough to illuminate an area that encompasses not only the roadway itself, but an area extending beyond the sides of the roadway so as to trigger roadside IEDs that may be several feet from the curb.

It is noted, although vehicle 330 is depicted as a terrestrial vehicle in FIG. 3, other implementations are possible in which SEPs are transported by an aircraft or sea craft navigating an airway or seaway, respectively. In any case, the vehicles may comprise drone vehicles or manned vehicles. Alternatively or additionally, it is contemplated that persons (e.g., on foot) could be used to carry SEP platforms. Optionally, reflectors 310 may also be employed to enhance sound energy coverage within the zone 308. The reflectors 310 may reside on terrestrial vehicles, aircraft, sea craft, persons, or combination thereof depending on implementation.

Figure 4:
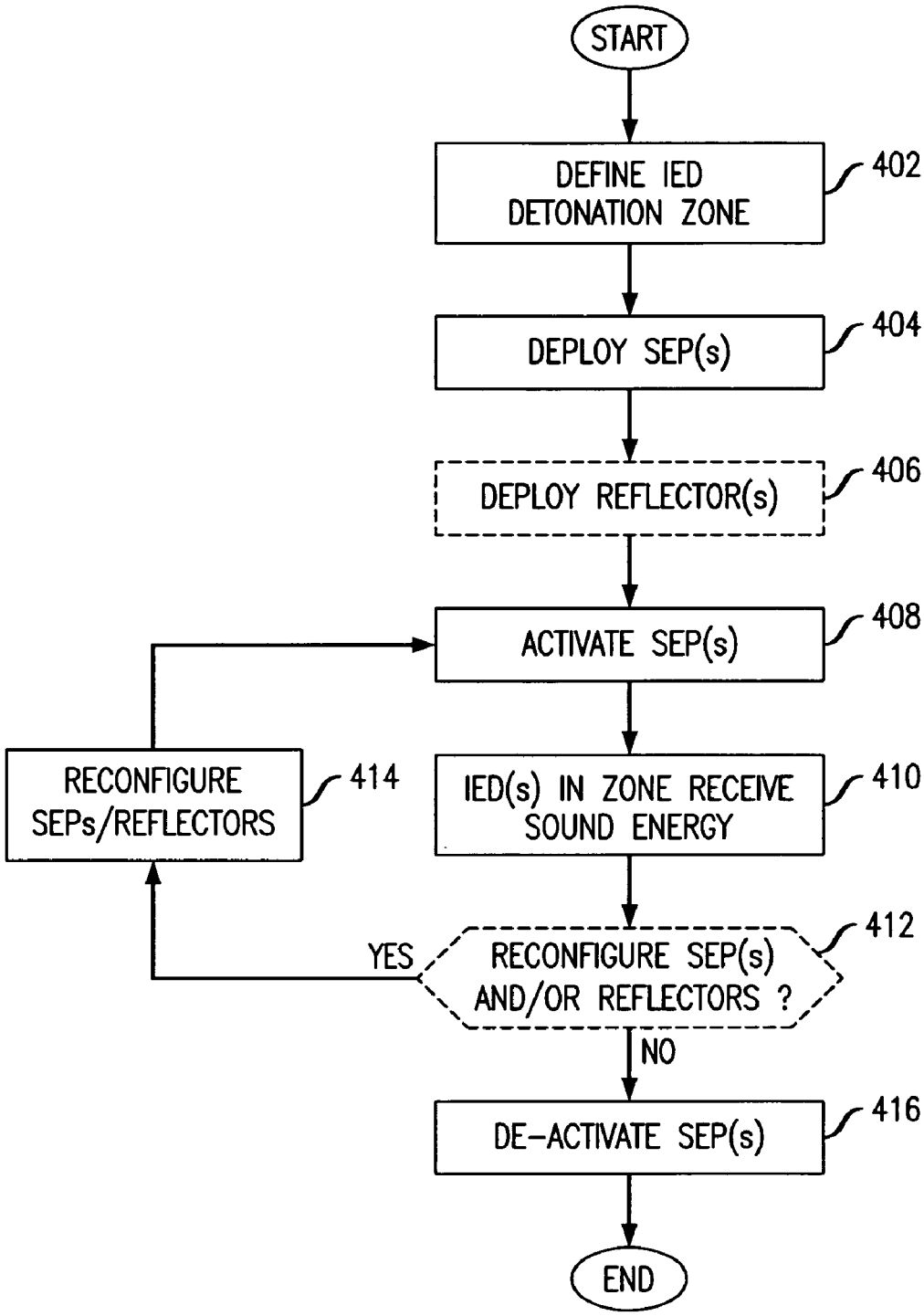
FIG. 4 is a flowchart of a method for implementing an IED defense system using mobile or stationary SEPs to force premature detonation of IEDs within an IED detonation zone.

Now turning to FIG. 4, there is shown a flowchart for implementing an IED defense system using mobile or stationary SEPs. At step 402, an authority or agency responsible for implementing an IED defense system defines an IED detonation zone. The IED detonation zone may define a stationary detonation zone such as described in relation to FIG. 2 or a mobile detonation zone traversing a transportation path such as described in relation to FIG. 3. As will be appreciated, multiple IED detonation zones may be defined to cover multiple geographic areas or transportation paths as needed or desired.

At step 404, the responsible authority or agency deploys one or more SEPs as necessary to obtain desired sound energy coverage within the zone. Optionally, at step 406, the authority or agency may also deploy one or more reflectors to enhance sound energy coverage within the zone. For example, in the case where the IED detonation zone defines a stationary zone, one or more SEPs and/or reflectors may be deployed at one or more predetermined locations residing within or proximate to the stationary zone as necessary to obtain desired sound energy coverage within the zone; or in the case where the IED detonation zone defines a mobile zone, one or more SEPs and/or reflectors may be deployed on drones or other suitable transport vehicles adapted to traverse a designated transportation path. As has been noted in relation to FIG. 1, the nature and type of the SEPs may be selected to produce one or more characteristic type(s) of sound energy signals and yielding corresponding pattern(s) that are believed to trigger detonation of IEDs. In one embodiment, the sound energy signals comprise high intensity or high volume sound waves. In another embodiment, the sound energy signals comprise a characteristic pattern ("noise print") of a potential target.

Sometime after the SEPs are deployed, the SEPs are activated at step 408 to radiate sound energy within the zone. Depending on implementation, the SEPs may be operated alone or in combination to produce a characteristic type of sound energy or multiple types of sound energy and at varying intensities, frequencies or the like to produce a desired characteristic pattern or patterns. The physical location and/or direction of the SEPs may be varied to produce beam patterns at multiple angles and directions or to sweep different paths, individually or collectively.

At step 410, IED(s) within the designated stationary or mobile zone receive the sound energy signals, causing the IED(s) to prematurely detonate if they include triggering mechanisms that respond to the sound energy signals.

Optionally, at step 412, the responsible authority or agency may choose to reconfigure one or more SEP(s) and/or reflectors to obtain different coverage or define a different IED detonation zone. If reconfiguration is desired, reconfiguration is accomplished at step 414. It is contemplated that reconfiguration may be accomplished while the SEP(s) remain active or after they are de-activated.

At some point when it is desired to cause sound energy transmissions to cease within the IED detonation zone, the SEPs are de-activated at step 416.

In one embodiment, activation or de-activation of the SEPs at steps 408 and 416 is implemented by software routines executed within the system controller 102. As has been noted, the system controller functionality may reside in a centralized platform; or controller functionality may reside in individual SEPs to allow for independent operation of the SEPs. Alternatively or additionally, one or more SEPs may be activated or de-activated responsive to human control. Generally, instructions for activating and operating the SEPs or de-activating the SEPs may be implemented on any computer-readable signal-bearing media residing within the system controller or residing in individual SEPs. The computer-readable signal-bearing media may comprise, for example and without limitation, floppy disks, magnetic tapes, CD-ROMs, DVD-ROMs, hard disk drives or electronic memory. The computer-readable signal-bearing media store software, firmware and/or assembly language for performing one or more functions relating to steps 408 and 416.

The present invention may be embodied in other specific forms without departing from its spirit or essential characteristics. The described embodiments are to be considered in all respects only as illustrative and not restrictive. For example, the SEPs may be deployed with or without a system controller 102; and the SEPs may be implemented alone or in combination to produce sound energy of various types and/or characteristics that may differ from the described embodiments. The scope of the invention is, therefore, indicated by the appended claims rather than by the foregoing description. All changes that come within the meaning and range of equivalency of the claims are to be embraced within their scope.

What is claimed is:

1. A method for implementing an IED defense system for forcing premature detonation of IEDs having a triggering mechanism responsive to sound energy signals, the IEDs being carried by a moving person or vehicle traveling on a road, the method comprising:

radiating in the air from one or more stationary sound energy platforms sound energy signals via speakers that are part of the platforms;

selecting the energy signals to be a characteristic noise print to which the IEDs are tuned as the triggering mechanism;

defining an IED detonation zone as a predetermined portion of the road along which the moving person or vehicle travels prior to entering a target area where the IED is intended to detonate;

locating the one or more stationary sound energy platforms off the road and adjacent to the portion of the road that defines the IED detonation zones;

activating the platforms by one or more controllers to radiate the sound energy signals upon the person or vehicle on the road entering the IED detonation zone;

the speakers being disposed to transmit the radiated sound energy signals across the road at the IED detonation zone to encounter the person or vehicle, the selected sound energy signals of the characteristic noise print forcing premature detonation of IEDs having a triggering mechanism stimulated to detonate in response to sound energy signals with the selected characteristic noise print within the IED detonation zone.

2. The method of claim 1, wherein a prospective target is a vehicle having a selected characteristic noise print of one of the group of a siren and a rumble of the vehicle.

3. The method of claim 1 comprising:

disposing one or more fixed reflectors off of but adjacent to the portion of the road defining the IED detonation zone, the one or more fixed reflectors adapted to receive and reflect the sound energy signals radiated from the speakers of the one or more platforms towards the IED detonation zone where the reflected signals are toward the IED detonation zone, yielding a combination of reflected sound energy signals from the one or more reflectors and sound energy signals from the speakers, the combination of selected sound energy signals forcing premature detonation of IEDs having a triggering mechanism responsive to the selected characteristic noise print within the IED detonation zone.

4. The method of claim 1 further comprising mechanically pivoting the speakers so that the speakers induce different angles of transmission of the sound energy signals towards the IED detonation zone and cause different sound wave patterns in the IED detonation zone.

5. The method of claim 1 further comprising the one or more controllers including a processor running under software instructions that controls the activation of the platforms.

* * * * *